US006298752B1

(12) United States Patent
Junkers

(10) Patent No.: US 6,298,752 B1
(45) Date of Patent: Oct. 9, 2001

(54) CONTINUOUS FLUID-OPERATED WRENCH

(76) Inventor: John K. Junkers, 7 Arrowhead La., Saddle River, NJ (US) 07540

( * ) Notice: Subject to any disclaimer, the term of this patent is extended or adjusted under 35 U.S.C. 154(b) by 0 days.

(21) Appl. No.: 09/344,893

(22) Filed: Jun. 25, 1999

(51) Int. Cl.[7] ..... B25B 13/46
(52) U.S. Cl. ..... 81/57.39
(58) Field of Search ..... 81/57.39, 60, 61, 81/57.44

(56) References Cited

U.S. PATENT DOCUMENTS

| | | | | |
|---|---|---|---|---|
| 2,712,256 | * | 7/1955 | Fish | 81/57.39 |
| 4,409,865 | | 10/1983 | Krautter et al. . | |
| 4,448,096 | * | 5/1984 | Collins | 81/57.39 |
| 4,644,829 | | 2/1987 | Junkers . | |
| 4,671,142 | | 6/1987 | Junkers . | |
| 5,029,497 | | 7/1991 | Junkers . | |
| 5,318,397 | | 6/1994 | Junkers . | |
| 5,979,273 | * | 11/1999 | Walton | 81/57.39 |
| 6,112,622 | * | 9/2000 | Reiman | 81/57.39 |

FOREIGN PATENT DOCUMENTS 40 42 070 7/1991 (DE) .
0 754 527 1/1997 (EP) .

* cited by examiner

*Primary Examiner*—D. S. Meislin
(74) *Attorney, Agent, or Firm*—Michael J. Striker

(57) ABSTRACT

A fluid operated wrench has fluid-operated drive including a cylinder, a piston reciprocatingly movable in the cylinder and having a piston rod with a piston rod end, a ratchet mechanism having a ratchet provided with a plurality of teeth, and at least two pawls operatably connectable with the piston rod end and engageable with a teeth of the ratchet so that during an advance stroke of the piston one of the at least two pawls engages with at least one ratchet tooth while the other of the at least two ratchets over at least one ratchet tooth, while during a return stroke of the piston the other of the at least two pawls engages with at least one ratchet tooth while the one of the at least two pawls ratchets over at least one ratchet tooth, [at least one of the at least two pawls being disengageable from and liftable above the teeth of the ratchet] and a disengaging unit which is activatable by an operator separately from the drive and can act on at least one pawl so as to distinguish it from and lift it above the ratchet teeth, so as to permit the ratchet to turn backwards to release a buildup torsion and material flex, so that the fluid operated wrench can be taken off a job.

4 Claims, 2 Drawing Sheets

FIG. 2A
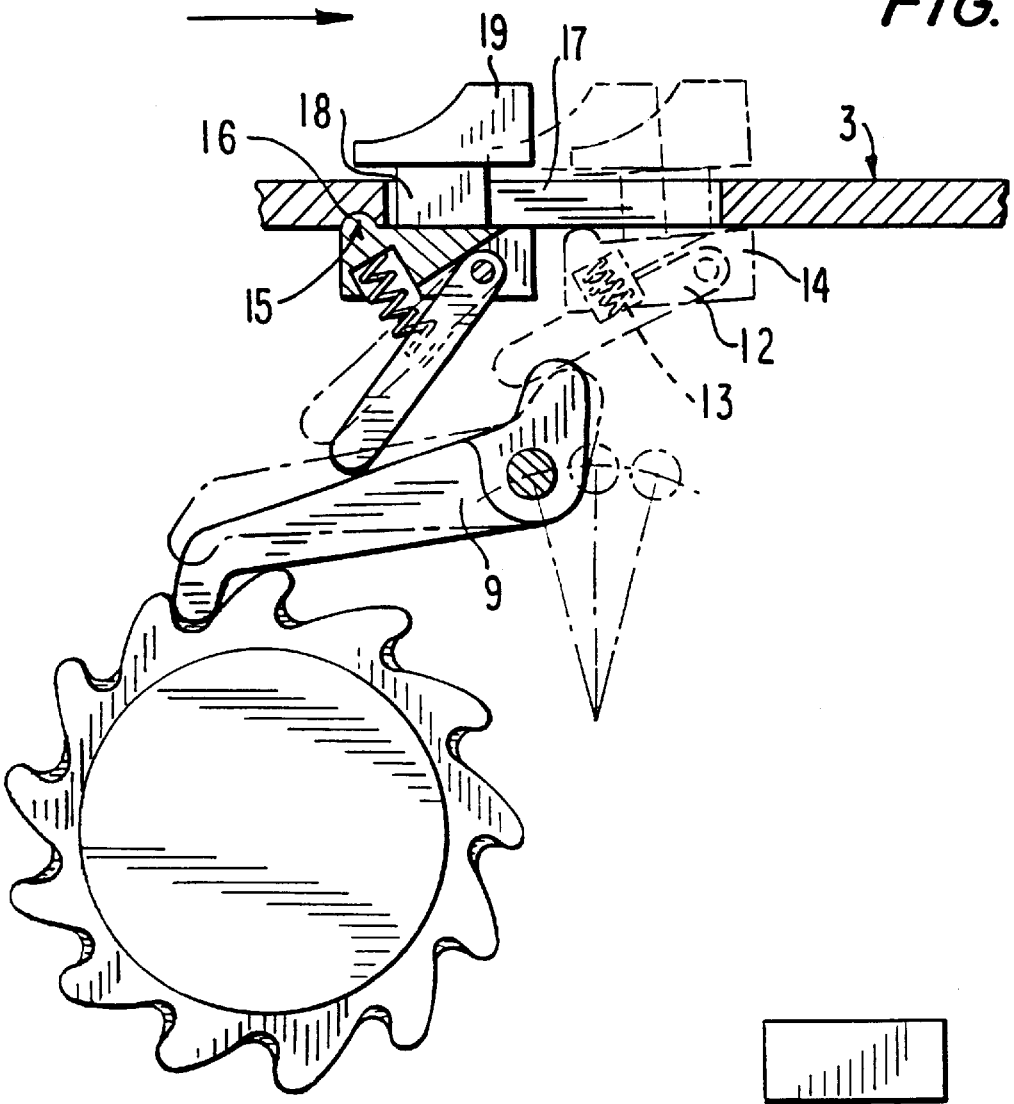
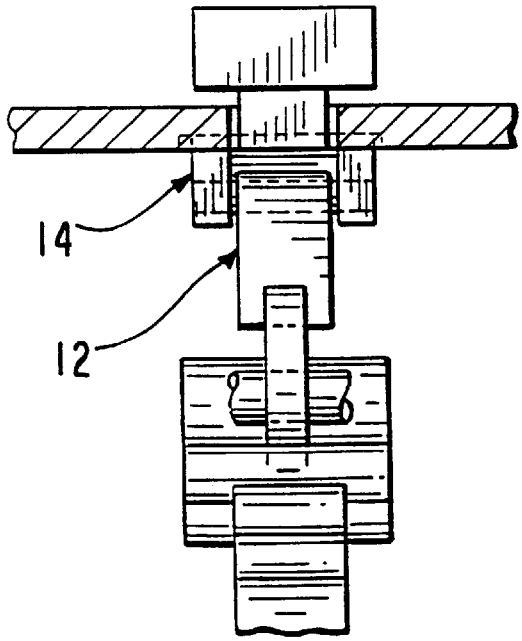
FIG. 2B

CONTINUOUS FLUID-OPERATED WRENCH

BACKGROUND OF THE INVENTION

The present invention relates to continuous-turning fluid operated wrenches.

Continuous turning fluid-operated wrenches are known in the art for example as disclosed in our U.S. Pat. Nos. 4,409,865 and 4,644,829. While the continuous turning fluid operated wrenches have been satisfactory, several new and important improvements had to be made under consideration of the fact that these tools are used for torque in excess of 500 ft.lbs. with the largest one going over 80,000 ft.lbs.

During the operation of continuous-turning fluid operated wrenches, on many occassions the bolt torsion and the flex of the tool parts lock the engaged pawl against the ratchet tooth in the pawl/ratchet mechanism. This creates enormous difficulties in removing the tool from a fastener which is tightened by the tool. In this situation it is not possible simply to reverse the drive and to release the corresponding pawl.

SUMMARY OF THE INVENTION

Accordingly, it is an object of present invention to provide a continuous-turning fluid operated wrench which avoids the disadvantages of the prior art.

More particularly it is an object of present invention to provide a continuous turning fluid operated wrench that can be taken off the nut when the bolt torsion and the flex of the tool parts lock the engaged pawl against the ratchet tooth in their rewinding process, with the use of a disengagement device that lets the tool operator disengage one of the driving pawls so as to allow the ratchet to turn slightly backwards and release the torsion build up and the flex in the tool parts to free the tool from the job.

SUMMARY OF THE INVENTION

Accordingly, it is an object of the present invention to provide a continuous turning fluid-operated wrench which avoids the disadvantages of the prior art.

In keeping with these objects, our features of the invention resides in a tool which has fluid-operated drive means including a cylinder, and a piston reciprocatingly movable in said cylinder and having a piston rod with a piston rod end; a ratchet mechanism having a ratchet provided with a plurality of teeth, and at least two pawls operatably connectable with said piston rod end and engageable with teeth of said ratchet so that during an advance stroke of the piston one of the pawls engages with at least one ratchet tooth while the other of pawl ratchets over at least one ratchet tooth, while during a return stroke of the piston the other of the pawls engages with at least one ratchet tooth while the one pawls ratchets over at least one ratchet tooth; and disengaging means which is separate from said drive means and actuatable by an operator so as to act on at least one of said at least two pawls to disengage said at least one pawl from and to lift said at least one pawl above said teeth of said ratchet, so as to permit said ratchet to turn backwards to release a buildup torsion and material flex, so that the fluid operated wrench can be taken off a job.

When the fluid operated wrench is designed in accordance with the present invention, then it is possible in the event when the bolt torsion and the flex of the tool parts lock the engaged pawl against the ratchet tooth, to easily disengage the pawl from the teeth of the of the ratchet and to lift it above the teeth of the ratchet, so as to permit the ratchet to turn backwards and to remove the fluid operated wrench from a fastener.

The novel features which are considered as characteristic for the present invention are set forth in particular in the appended claims. The invention itself, however, both as to its construction and its method of operation, together with additional objects and advantages thereif, will be best understood from the following description of specific embodiments when read in connection with the accompanying drawings.

BRIEF DESCRIPTION OF THE DRAWINGS

FIGS. 2A and 2B are a side view and an end view showing the continuous turning fluid operated wrench which is provided with a new inventive mechanism in accordance with one embodiment of the present invention

DESCRIPTION OF PREFERRED EMBODIMENTS

Figure 1:
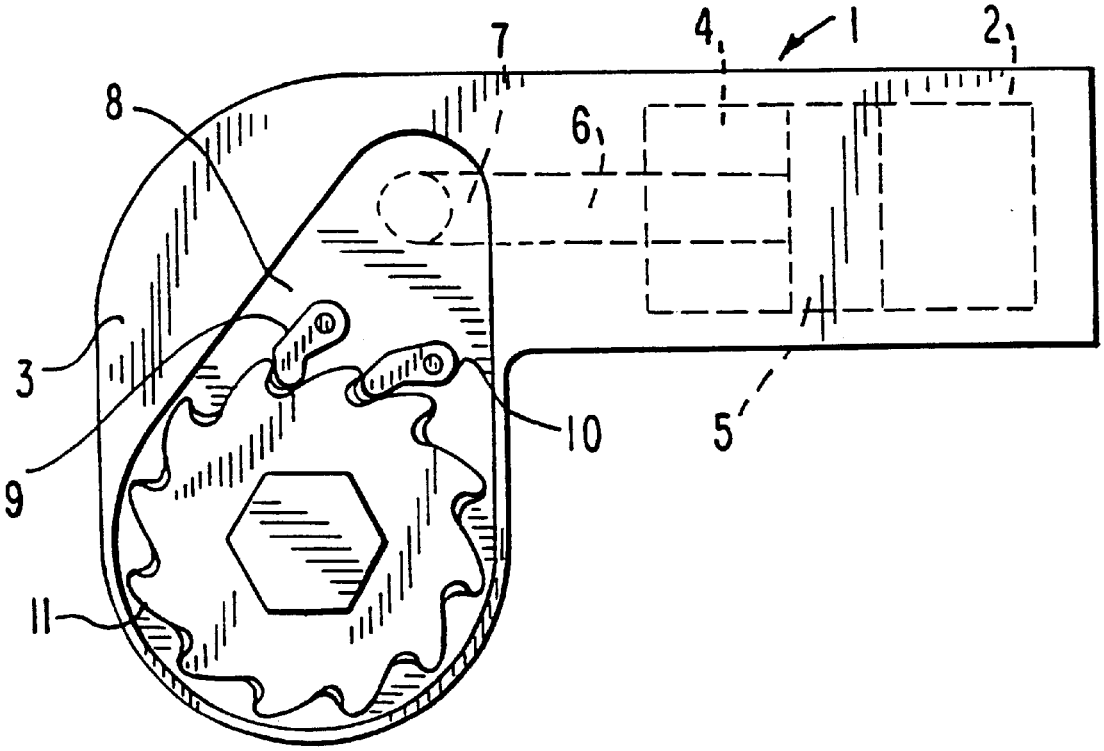
FIG.1 PRIOR ART
FIG. 1 is View showing a continuous turning fluid operated wrench which is known in the art.

A continuous turning fluid operated wrench has a housing which is identified with reference numeral 1 and has a first housing part 2 and a second housing part 3. The first housing part 2 accommodates fluid-operated drive means which include a cylinder 4 which forms a working chamber, a piston 5 reciprocatingly movable in the cylinder, and a piston rod 6 having a piston rod end 7. The second housing portion 3 accommodates a ratchet mechanism which includes a drive plate 8, two poles 9 and 10 turnably connected with a drive plate 8, and a ratchet 11 provided with a plurality of teeth engageable by the pawls 9 and 10.

During the operation of the continuous turning fluid operated wrench when the fluid is supplied into the cylinder so that the piston 5 moves in one direction, one of the pawls engages with the teeth of the ratchet 11 and turns the ratchet in one direction while the other pawl just ratchets over the teeth. When the fluid is supplied in the cylinder from the opposite side and the piston moves in a reverse stroke, the first pawl ratchets over the teeth of the ratchet while the second pawl engages with the teeth of the ratchet and turns it also in the same direction. This substantially corresponds to the known construction of the continuous turning fluid operated wrenches.

In accordance with the present invention, disengaging means is provided which is actuatable by an operator and separate from the drive of the tool, such that at least one of the pawls 9 and 10 can be easily disengage and lifted above the teeth of the ratchet 11 so as to permit the ratchet to turn backwards to release a build up torsion and material flex, so that the fluid-operated wrench can be taken off the job. For this purpose, a lever 12 which is spring loaded by a spring 13 is provided. The lever 12 is pivotably mounted on a slider 14 which has a projection 15 engageable in a groove 16 of the housing portion 3. The housing portion 3 has a slot 17, and a connecting element 18 extends through the slot 17 and connects the slider 14 with a pushbutton 19. As can be seen from the drawings, the pawl 9 has two parts located at opposite sides of a pivot point.

During a normal operation of the fluid-operated wrench, the slider is located at a position shown at the left side of FIG. 2*a* and is held in place by the projection 15 engaging in the groove 16 of the housing portion. The spring loaded lever 12 exerts a force on the pawl 9 keeping it in engagement with the teeth of the ratchet 11. If it is necessary to remove the fluid-operated wrench from the job, the pawl 9 has to be released. For this purpose the slider 14 is pushed by an operator to the right and held in a far position from the groove 16 of the housing. The spring loaded lever 12 now exerts a force to the part of the pawl 9 which is located at an opposite side from the pivot point of the pawl, the left arm of the pawl is lifted from the teeth, and the pawl 9 is disengaged from the ratchet. Upon release of the pushbutton 19, the spring loaded lever 12 again reacts against the pawl 9 and pushes the slider 12 back into the starting position in which the projection 14 engages in the groove 15.

It will be understood that each of the elements described above, or two or more together, may also find a useful application in other types of constructions differing from the types described above.

While the invention has been illustrated and described as embodied in a continuous fluid-operated wrench, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

It will be understood that each of the elements described above, or two or more together, may also find a useful application in other types of constructions differing from the types described above.

While the invention has been illustrated and described as embodied in a continuous fluid-operated wrench, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

What is claimed is:

1. A fluid operated wrench comprising fluid-operated drive means including a cylinder; and a piston reciprocatingly movable in said cylinder and having a piston rod with a piston rod end; a ratchet mechanism having a ratchet provided with a plurality of teeth, and at least two pawls operatively connectable with said piston rod end and engageable with said teeth of said ratchet so that during an advance stroke of said piston one of said at least two pawls engages with at least one ratchet tooth while the other of said at least two pawls, ratchets over at least one ratchet tooth, while during a return stroke of said piston the other of said at least two pawls engages with at least one ratchet tooth while said one of said at least two pawls ratchets over at least one ratchet tooth; and disengaging means which is separate from said drive means and actuatable by an operator so as to act on at least one of said at least two pawls to disengage said at least one pawl from and to lift said at least one pawl above said teeth of said ratchet, so as to permit said ratchet to turn backwards to release a buildup torsion and material flex, so that the fluid operated wrench can be taken off a job.

2. A fluid operated wrench as defined in claim 1; and further comprising a housing including a first housing portion which accommodates said fluid-operated drive, and a second housing portion which accommodates said ratchet mechanism.

3. A fluid operated wrench as defined in claim 2, wherein said disengaging means include a spring-biased lever urging said at least one pawl into engagement with said ratchet, and means for displacement of said lever to a position in which it is no longer urges said at least one pawl so that said at least one pawl is disengageable from said ratchet.

4. A fluid-operated wrench as defined in claim 1; and further comprising a fluid-operated pump which supplies a fluid to said fluid-operated drive means through a valve.

* * * * *